US009567985B2

(12) United States Patent
Akita et al.

(10) Patent No.: US 9,567,985 B2
(45) Date of Patent: Feb. 14, 2017

(54) HIGH-PRESSURE PUMP

(75) Inventors: Tatsuhiko Akita, Okazaki (JP); Kenichi Saito, Nisshin (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 525 days.

(21) Appl. No.: 13/989,621

(22) PCT Filed: Dec. 12, 2011

(86) PCT No.: PCT/IB2011/003003

§ 371 (c)(1),
(2), (4) Date: May 24, 2013

(87) PCT Pub. No.: WO2012/085635

PCT Pub. Date: Jun. 28, 2012

(65) Prior Publication Data

US 2013/0266465 A1 Oct. 10, 2013

(30) Foreign Application Priority Data

Dec. 24, 2010 (JP) ..... 2010-287337

(51) Int. Cl.

| | |
|---|---|
| ***F04B 7/02*** | (2006.01) |
| ***F02M 53/00*** | (2006.01) |
| ***F02M 55/04*** | (2006.01) |
| ***F02M 59/44*** | (2006.01) |

(52) U.S. Cl.

CPC ..... *F04B 7/02* (2013.01); *F02M 53/00* (2013.01); *F02M 55/04* (2013.01); *F02M 59/44* (2013.01); *F02M 2200/9015* (2013.01)

(58) Field of Classification Search

CPC .... F02M 59/447; F02M 59/027; F02M 59/32; F02M 37/043; F02M 37/0041; F02M 55/04; F02M 53/046; F02M 2200/9015; F02M 45/063; F04B 7/02

USPC ..... 417/470, 540, 443, 441; 92/86, 143

See application file for complete search history.

(56) References Cited

U.S. PATENT DOCUMENTS

| | | | | |
|---|---|---|---|---|
| 7,604,462 | B2 * | 10/2009 | Inoue | F04B 1/0408 417/439 |
| 7,654,249 | B2 * | 2/2010 | Fischer et al. | 123/446 |
| 8,317,501 | B2 * | 11/2012 | Inoue | 417/543 |
| 2009/0298364 | A1 * | 12/2009 | Kato et al. | 440/88 F |

(Continued)

FOREIGN PATENT DOCUMENTS

| | | | |
|---|---|---|---|
| JP | 2004-332654 | A | 11/2004 |
| JP | 2009-097462 | A | 5/2009 |
| JP | 2010-185410 | A | 8/2010 |

*Primary Examiner* — Nathaniel Wiehe
*Assistant Examiner* — Richard Drake
(74) *Attorney, Agent, or Firm* — Sughrue Mion, PLLC

(57) ABSTRACT

A high-pressure pump includes a plunger capable of reciprocating, and a housing having a pressurizing chamber in which fuel is pressurized by the plunger, and a fuel chamber through which the fuel flows toward and from the pressurizing chamber. The pump includes a spring that biases the plunger so as to increase the volume of the pressurizing chamber, and a spring seat that is fixed to the housing and is in contact with one end of the spring. A first space that communicates with the fuel chamber via a fuel passage is provided between the bottom of the spring seat and the housing, and a top face of the bottom exposed to the first space is covered with a heatinginsulating member.

5 Claims, 5 Drawing Sheets

(56) References Cited

U.S. PATENT DOCUMENTS

2012/0195778 A1* 8/2012 Koga ..... F04B 1/0421
417/540
2013/0302194 A1* 11/2013 Ikoma ..... F02M 37/0041
417/441

* cited by examiner

HIGH-PRESSURE PUMP

BACKGROUND OF THE INVENTION

1. Field of the Invention

The invention relates to a high-pressure pump.

2. Description of Related Art

A high-pressure pump used for supplying fuel to injectors of an internal combustion engine, such as a diesel engine or a gasoline engine, includes a plunger capable of reciprocating in a cylinder, and a housing having a pressurizing chamber in which the fuel is pressurized by the plunger, and a fuel chamber through which the fuel flows toward and from the pressurizing chamber. A known example of the high-pressure pump (as disclosed in, for example, Japanese Patent Application Publication No. 2010-185410 (JP-A-2010-185410)) includes a damper device for dampening pressure pulsation of the fuel which occurs due to reciprocating movement of the plunger.

The high-pressure pump as described in JP-A-2010-185410 includes a spring that biases the plunger in such a direction as to increase the volume of the pressurizing chamber, and a spring seat (corresponding to an oil seal holder 25 shown in JP-A-2010-185410) that is fixed to the housing and is in abutting contact with one end of the spring. Also, a space (corresponding to a passage 107 shown in JP-A-2010-185410) through which the fuel flows is provided between the bottom of the spring seat and the housing, and the space communicates with the fuel chamber via a fuel passage (corresponding to a passage 108 shown in JP-A-2010-185410) formed in the housing.

In operation, the spring seat may receive heat of engine oil for lubricating cams, springs, etc., to be heated to a high temperature, and the fuel flowing in the above-mentioned space may receive the heat from the spring seat, so that the temperature of the fuel in the high-pressure pump may be generally increased. Due to the temperature rise of the fuel, vapor may be produced in the high-pressure pump, and may affect control of the discharge amount of the high-pressure pump. In particular, when the engine is operating in fuel-cut mode, or when the engine is stopped while it is in a high-load operating condition (i.e., when the engine is in a condition of so-called "high-temperature dead soak"), for example, the fuel having a high temperature remains in the high-pressure pump, and the above-described situation may occur.

SUMMARY OF THE INVENTION

The invention provides a high-pressure pump that can suppress temperature rise of the fuel in the high-pressure pump, and can reduce an influence of the temperature rise on control of the discharge amount of the high-pressure pump.

The invention is concerned with a high-pressure pump including a plunger capable of reciprocating, and a housing having a pressurizing chamber in which fuel is pressurized by the plunger, and a fuel chamber through which the fuel flows toward and from the pressurizing chamber. According to one aspect of the invention, the high-pressure pump includes a spring that biases the plunger in such a direction as to increase the volume of the pressurizing chamber, and a spring seat that is fixed to the housing and is in abutting contact with one end of the spring, wherein a first space through which the fuel flows is provided between a bottom of the spring seat and the housing, and the first space communicates with the fuel chamber via a fuel passage formed in the housing. The high-pressure pump further includes a heat insulating member that covers a face of the bottom of the spring seat, which face is exposed to the first space.

In the high-pressure pump constructed according to the above aspect of the invention, the heat insulating member provided on the spring seat curbs heat exchange between the spring seat and the fuel flowing through the above-indicated space, so that the amount of heat which the fuel flowing through the first space receives from the spring seat can be reduced. Consequently, the temperature rise of the fuel in the high-pressure pump can be suppressed, and vapor is less likely or unlikely to be produced in the high-pressure pump, resulting in reduction of an influence on control of the discharge amount of the high-pressure pump.

In the high-pressure pump according to the above aspect of the invention, the spring seat may include a cylindrical portion that extends from an inner periphery of the bottom of the spring seat, in a direction opposite to the pressurizing chamber, and an annular space through which the fuel flows may be provided between the cylindrical portion of the spring seat and the housing. The annular space communicates with the first space between the bottom of the spring seat and the housing. In this arrangement, at least a portion of an inner wall surface of the cylindrical portion may be covered with the heat insulating member. In one form of the invention, an upper portion of the inner wall surface of the cylindrical portion, which is located adjacent to the bottom of the spring seat, is covered with the heat insulating member. In another form of the invention, the entire area of the inner wall surface of the cylindrical portion is covered with the heat insulating member.

With the above arrangement, the heat insulating member provided on the spring seat curbs or restricts heat exchange between the spring seat and the fuel flowing through the annular space, so that the amount of heat which the fuel flowing through the annular space receives from the spring seat can be reduced. Thus, the temperature rise of the fuel in the high-pressure pump can be further suppressed. Consequently, the production of vapor in the high-pressure pump can be further curbed or prevented, and the influence of the vapor production on the control of the discharge amount of the high-pressure pump can be further reduced.

In the high-pressure pump according to the above aspect of the invention, an air layer may be interposed between the heat insulating member and the spring seat.

With the above arrangement, the heat insulating member and the spring seat with the air layer interposed therebetween provides a double-pipe structure, which can effectively curb heat exchange between the spring seat and the fuel flowing through the first space. Accordingly, the amount of heat which the fuel flowing through the first space receives from the spring seat can be effectively reduced. Consequently, the temperature rise of the fuel in the high-pressure pump can be further suppressed, and the influence of the temperature rise on the control of the discharge amount of the high-pressure pump can be further reduced.

The heat insulating member may be formed of a material which has a lower thermal conductivity than that of the spring seat, and is highly resistant to the fuel. If the heat insulating member is formed of PTFE (polytetrafluoroethylene), for example, the heat insulating member can be produced at low cost, and can be easily mounted on the spring seat.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

One embodiment of the invention will be described with reference to the accompanying drawings. In the following embodiment, the invention is applied to a high-pressure pump for use in a vehicle.

Figure 1:
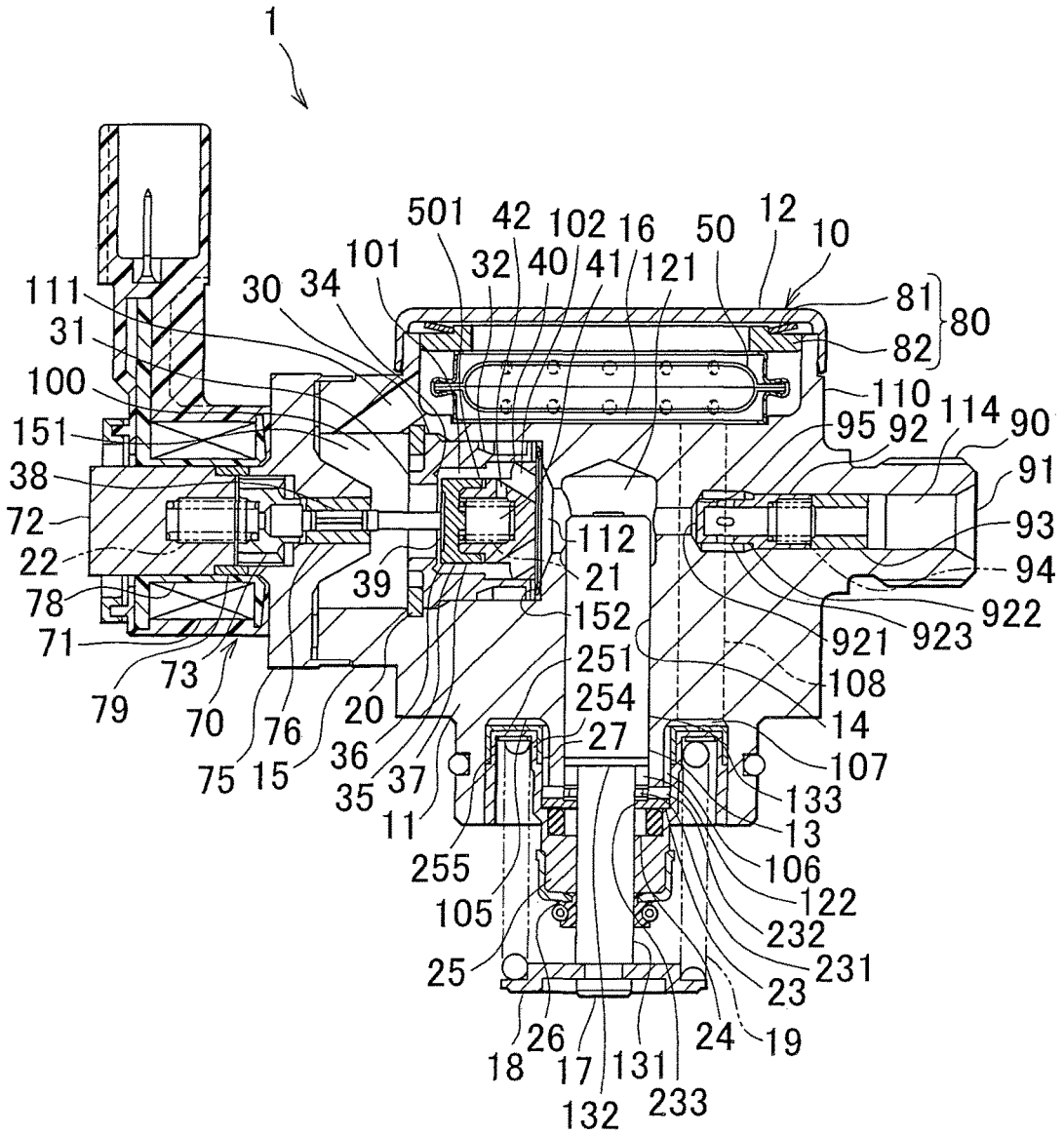
FIG. 1 is a cross-sectional view showing the construction of a high-pressure pump according to one embodiment of the invention.

The high-pressure pump 1 illustrated in FIG. 1 is a fuel pump that supplies fuel to injectors of an engine, such as a diesel engine or a gasoline engine, and is attached to a head cover of the engine, for example. The high-pressure pump 1 includes a housing 11, a plunger 13, a valve body 30, an electromagnetic drive unit 70, a damper device 10, a lid member 12, and so forth.

The housing 11 is formed of, for example, martensite stainless steel. A cylinder 14 is formed in the housing 11. The plunger 13 is supported in the cylinder 14 such that the plunger 13 can reciprocate in the axial direction. Also, a guide passage 111, an intake passage 112, a pressurizing chamber 121, a discharge passage 114, etc. are formed in the housing 11.

The housing 11 has a cylindrical portion 15. A passage 151 that communicates with the guide passage 111 and the intake passage 112 is formed in the cylindrical portion 15. The cylindrical portion 15 is formed so as to extend in a direction substantially perpendicular to the central axis of the cylinder 14, and the inside diameter of the cylindrical portion 15 changes halfway. A stepped surface 152 is formed on a portion of the cylindrical portion 15 in which the inside diameter changes. The valve body 30 is provided in the passage 151 of the cylindrical portion 15.

A fuel chamber 16 is formed between the housing 11 and the lid member 12. The fuel chamber 16 is formed with a fuel inlet (not shown), and the fuel inlet is connected to a low-pressure fuel pipe (not shown). In operation, fuel in a fuel tank is supplied from the low-pressure fuel pipe to the fuel chamber 16 through the fuel inlet, by means of a low-pressure fuel pump (not shown). The guide passage 111 communicates with the fuel chamber 16 and the passage 151 of the cylindrical portion 15. The intake passage 112 communicates at one end thereof with the pressurizing chamber 121. The other end of the intake passage 112 is open to the inside of the stepped surface 152. The guide passage 111 and the intake passage 112 are connected to each other via the interior of the valve body 30. The pressurizing chamber 121 communicates with the discharge passage 114, at the side of the chamber 121 opposite to the intake passage 112. In this embodiment, these fuel passages are generally represented by a fuel passage 100.

The plunger 13 is supported by the cylinder 14 of the housing 11 such that the plunger 13 can reciprocate in the axial direction. The plunger 13 consists of a small-diameter portion 131, and a large-diameter portion 133 having a larger diameter than the small-diameter portion 131. The large-diameter portion 133 is connected to the side of the small-diameter portion 131 closer to the pressurizing chamber 121, and a stepped surface 132 is formed between the large-diameter portion 133 and the small-diameter portion 131. The pressurizing chamber 121 is formed on the side of the large-diameter portion 133 opposite to the small-diameter portion 131. A generally annular plunger stopper 23 that is in contact with the housing 11 is provided on the side of the stepped surface 132 of the plunger 13 opposite to the pressurizing chamber 121.

The plunger stopper 23 has a recessed portion 231 formed on an end face thereof closer to the pressurizing chamber 121 to be recessed in a generally disc-like shape in a direction away from the pressurizing chamber 121, and a groove channel 232 that extends radially outwards from the recessed portion 231 to the outer edge of the plunger stopper 23. The diameter of the recessed portion 231 is generally equal to the outside diameter of the large-diameter portion 133 of the plunger 13. In a central portion of the recessed portion 231, a hole 233 is formed which extends through the plunger stopper 23 in the direction of the thickness thereof. The small-diameter portion 131 of the plunger 13 is inserted through the hole 233. Also, the end face of the plunger stopper 23 closer to the pressurizing chamber 121 is in contact with the housing 11. The stepped surface 132 of the plunger 13, the outer wall of the small-diameter portion 131, the inner wall of the cylinder 14, the recessed portion 231 of the plunger stopper 23, and a seal member 24 cooperate to form a generally annular, variable volume chamber 122.

A recessed portion 105 that is recessed in a generally annular shape toward the pressurizing chamber 121 is formed at the radially outer side of an end portion of the cylinder 14 opposite to the pressurizing chamber 121. A spring seat 25 is fitted in the recessed portion 105. In this embodiment, the spring seat 25 is formed integrally with the seal member 24 and an oil seal holder that supports an oil seal 26. The spring seat 25 is fixed to the housing 11. The seal member 24 is sandwiched between the spring seat 25 and the plunger stopper 23. The seal member 24 consists of a seal ring made of, for example, PTFE and located on the radially inner side thereof, and an O ring located on the radially outer side. The seal member 24 controls the thickness of a fuel film around the small-diameter portion 131, so as to suppress or prevent leakage of the fuel into the engine due to sliding movement of the plunger 13. The oil seal 26 is mounted on an end portion of the spring seat 25 opposite to the pressurizing chamber 121. The oil seal 26 restricts or controls the thickness of the oil film around the small-diameter portion 131, so as to suppress or prevent leakage of the oil due to sliding movement of the plunger 13.

An annular passage 106 and a passage 107 are formed between the spring seat 25 and the housing 11. The passage 107 is defined as a space provided between a bottom 251 of the spring seat 25, and the housing 11. The passage 106 is defined as an annular space provided between a radially inner cylindrical portion 254 that extends from the inner periphery of the bottom 251 of the spring seat 25 in a direction away from the pressurizing chamber 121 (downward in FIG. 1), and the housing 11. A radially outer cylindrical portion 255 that extends from the outer periphery of the bottom 251 of the spring seat 25 in the direction away from the pressurizing chamber 121 is in close contact with the housing 11.

The passage 106 and the passage 107 communicate with each other. Also, a passage 108 that communicates the passage 107 with the fuel chamber 16 is formed in the housing 11. The passage 106 and the groove channel 232 of the plunger stopper 23 communicate with each other. Thus, the groove channel 232, passage 106, passage 107, and the passage 108 communicate with each other, so that the variable volume chamber 122 communicates with the fuel chamber 16.

A head 17 is provided on the side of the small-diameter portion 131 of the plunger 13 opposite to the large-diameter portion 133, and the head 17 is joined to a spring seat 18. A spring 19 is provided in a compressed state between the spring seats 18, 25. Namely, one end portion (closer to the pressurizing chamber 121) of the spring 19 is in contact with the bottom 251 of the spring seat 25 fixed to the housing 11, and the other end portion is in contact with the spring seat 18 joined to the head 17. While the plunger 13 is driven by a cam that contacts the plunger 13 via a tappet (not shown), so as to reciprocate within the cylinder 14, the tappet is biased toward the cam (downwards in FIG. 1) via the spring seat 18, due to the elastic force of the spring 19. Namely, the spring 19 biases the plunger 13 in such a direction as to increase the volume of the pressurizing chamber 121.

The volume of the variable volume chamber 122 varies in accordance with the reciprocating movement of the plunger 13. When the volume of the pressurizing chamber 121 decreases due to movement of the plunger 13 on the metering stroke or pressurizing stroke, the volume of the variable volume chamber 122 increases, so that the fuel is drawn from the fuel chamber 16 connected to the fuel passage 100 into the variable volume chamber 122, via the passage 108, passage 107, passage 106, and the groove channel 232. Also, on the metering stroke, a part of low-pressure fuel discharged from the pressurizing chamber 121 can be drawn into the variable volume chamber 122. It is thus possible to curb or prevent transmission of fuel-pressure pulsation to the low-pressure fuel pipe due to discharge of the fuel from the pressurizing chamber 121.

On the other hand, when the volume of the pressurizing chamber 121 increases due to movement of the plunger 13 on the intake stroke, the volume of the variable volume chamber 122 decreases so that the fuel is fed from the variable volume chamber 122 into the fuel chamber 16. In this connection, the volume of the pressurizing chamber 121 and the volume of the variable volume chamber 122 are determined solely by the position of the plunger 13. Therefore, since the fuel is fed from the variable volume chamber 122 to the fuel chamber 16 at the same time that the fuel is drawn into the pressurizing chamber 122, pressure reduction in the fuel chamber 16 is restricted or curbed, and the amount of the fuel drawn into the pressurizing chamber 121 through the fuel passage 100 is increased. Consequently, the efficiency at which the fuel is drawn into the pressurizing chamber 122 is improved.

A discharge valve unit 90 that forms a fuel outlet 91 is provided on the discharge passage 114 side of the housing 11. The discharge valve unit 90 is operable to permit and inhibit discharge of the fuel pressurized in the pressurizing chamber 121. The discharge valve unit 90 has a check valve 92, a restriction member 93, and a spring 94. The check valve 92, which is formed in a cylindrical shape with a bottom, consists of a bottom portion 921, and a cylindrical portion 922 that extends in a cylindrical shape from the bottom portion 921 in a direction away from the pressurizing chamber 121. The check valve 92 is provided in the discharge passage 114 such that it can reciprocate in the passage 114. The restriction member 93 is formed in a cylindrical shape, and is fixed to the housing 11 that forms the discharge passage 114. One end portion of the spring 94 is in contact with the restriction member 93, and the other end portion is in contact with the cylindrical portion 922 of the check valve 92. The check valve 92 is biased toward a valve seat 95 provided on the housing 11, due to the elastic force of the spring 94. The discharge passage 114 is closed when the end of the check valve 92 on the side of the bottom portion 921 rests on the valve seat 95, and the discharge passage 114 is opened when the same end of the check valve 92 moves away from the valve seat 95. When the check valve 92 moves away from the valve seat 95, one end of the cylindrical portion 922 opposite to the bottom portion 921 comes into contact with the restriction member 93, so that the movement of the check valve 92 is restricted.

As the pressure of the fuel in the pressurizing chamber 121 increases, the force which the check valve 92 receives from the fuel fed from the pressurizing chamber 121 increases. Then, if the force which the check valve 92 receives from the fuel fed from the pressurizing chamber 121 becomes larger than the sum of the elastic force of the spring 94 and the force received from the fuel present on the downstream side of the valve seat 95, namely, the fuel in a delivery pipe (not shown), the check valve 92 moves away from the valve seat 95. As a result, the fuel in the pressurizing chamber 121 passes through a through-hole 923 formed in the cylindrical portion 922 of the check valve 92 and the interior of the cylindrical portion 922, and is discharged from the fuel outlet 91 to the outside of the high-pressure pump 1.

As the pressure of the fuel in the pressurizing chamber 121 decreases, on the other hand, the force which the check valve 92 receives from the fuel fed from the pressurizing chamber 121 is reduced. Then, if the force which the check valve 92 receives from the fuel fed from the pressurizing chamber 121 becomes smaller than the sum of the elastic force of the spring 94 and the force received from the fuel present on the downstream side of the valve seat 95, the check valve 92 rests on the valve seat 95. As a result, the fuel in the delivery pipe is prevented from flowing into the pressurizing chamber 121 via the discharge passage 114.

The valve body 30 is press-fitted in the passage 151 of the housing 11, and is fixed to the inner wall of the passage 151 by means of an engaging member 20, or the like. The valve body 30 has a generally annular valve seat portion 31, and a cylindrical portion 32 that extends in a cylindrical shape from the valve seat portion 31 toward the pressurizing chamber 121. An annular valve seat 34 is formed on a wall surface of the valve seat portion 31 closer to the pressurizing chamber 121.

A valve member 35 is provided inside the cylindrical portion 32 of the valve body 30. The valve member 35 has a generally disc-like disc portion 36, and a guide portion 37 that extends in a hollow, cylindrical shape from the outer periphery of the disc portion 36 toward the pressurizing chamber 121. A recessed portion 39 that is recessed in a generally disc-like shape in a direction away from the valve seat 34 is formed in one end portion of the disc portion 36 closer to the valve seat 34. The inner circumferential wall of the valve member 35 which forms the recessed portion 39 is tapered such that the diameter decreases toward the pressurizing chamber 121. An annular fuel passage 101 is formed between the inner wall of the cylindrical portion 32 of the valve body 30, and the outer walls of the disc portion 36 and guide portion 37. As the valve member 35 reciprocates, the disc portion 36 comes into contact with the valve seat 34 or moves away from the valve seat 34, thereby to inhibit or permit flow of the fuel that flows through the fuel passage 100. The recessed portion 39 receives the dynamic pressure of the fuel flowing from the passage 151 into the annular fuel passage 101. A stopper 40 is provided on the pressurizing chamber 121 side of the valve member 35, and is fixed to the inner wall of the cylindrical portion 32 of the valve body 30.

The inside diameter of the guide portion 37 of the valve member 35 is set to be slightly larger than that of one end portion of the stopper 40 closer to the valve member 35. Therefore, when the valve member 35 reciprocates in a valve opening direction or valve closing direction, the inner wall of the guide member 37 slides against the outer wall of the stopper 40. In this manner, the reciprocating movement of the valve member 35 in the valve opening direction or valve closing direction is guided.

A spring 21 is provided between the stopper 40 and the valve member 35. The spring 21 is located inside the guide member 37 of the valve member 35 and the stopper 40. One end portion of the spring 21 is in contact with the inner wall of the stopper 40, and the other end portion is in contact with the disc portion 36 of the valve member 35. The valve member 35 is biased away from the stopper 40, namely, in the valve closing direction, due to the elastic force of the spring 21.

An end portion of the guide member 37 of the valve member 35 closer to the pressurizing chamber 121 can abut on a stepped surface 501 provided on the outer wall of the stopper 40. When the valve member 35 abuts on the stepped surface 501, the movement of the valve member 35 toward the pressurizing chamber 121, namely, in the valve opening direction, is restricted or inhibited by the stopper 40. The stopper 40, when viewed from the side of the pressurizing chamber 121, covers the wall of the valve member 35 which faces the pressurizing chamber 121, such that the wall is hidden behind the stopper 40. With this arrangement, the flow of the low-pressure fuel from the pressurizing chamber 121 side toward the valve member 35 side on the metering stroke exerts a reduced influence of the dynamic pressure on the valve member 35.

A volume chamber 41 is formed between the stopper 40 and the valve member 35. The volume of the volume chamber 41 varies due to reciprocation of the valve member 35. Also, the stopper 40 is formed with a conduit 42 that communicates with the volume chamber 41 and the annular fuel passage 101. Therefore, the fuel in the passage 102 can flow into the volume chamber 41. The stopper 40 is formed with a plurality of passages 102 that are inclined with respect to the axis of the stopper 40, and the passages 102 communicate with the annular fuel passage 101 and the intake passage 112. The passages 102 are formed at a plurality of locations along the circumferential direction of the stopper 40.

The fuel passage 100 as described above includes the annular fuel passage 101 and the passages 102. Thus, the fuel passage 100 communicates the fuel chamber 16 with the pressurizing chamber 121. When the fuel is directed from the fuel chamber 16 toward the pressurizing chamber 121, the fuel flows through the guide passage 111, passage 151, annular fuel passage 101, passages 102, and the intake passage 112, in the order of description. On the other hand, when the fuel is directed from the pressurizing chamber 121 toward the fuel chamber 16, the fuel flows through the intake passage 112, passages 102, annular fuel passage 101, passage 151, and the guide passage 111, in the order of description.

The electromagnetic drive unit 70 has a coil 71, a stator core 72, a movable core 73, and a flange 75. The coil 71 is wound on a spool 78 made of resin, and generates a magnetic field when the coil 71 is energized. The stator core 72 is formed of a magnetic material. The stator core 72 is placed inside the coil 71. The movable core 73 is formed of a magnetic material. The movable core 73 is located so as to be opposed to the stator core 72. The movable core 73 is placed inside a cylindrical member 79 and the flange 75, such that the movable core 73 can reciprocate in the axial direction. The cylindrical member 79 is formed of a non-magnetic material, and serves to prevent magnetic short-circuiting between the stator core 72 and the flange 75.

The flange 75 is formed of a magnetic material, and is mounted on the cylindrical portion 15 of the housing 11. The flange 75 retains or holds the electromagnetic drive unit 70 on the housing 11, and closes an end portion of the cylindrical portion 15. A guide cylinder 76 formed in a cylindrical shape is provided in a central portion of the flange 75.

A needle 38, which is formed in a generally columnar shape, is provided inside the guide cylinder 76 of the flange 75. The inside diameter of the guide cylinder 76 is slightly larger than the outside diameter of the needle 38. Therefore, the needle 38 reciprocates while sliding along the inner wall of the guide cylinder 76. Thus, the reciprocation of the needle 38 is guided by the guide cylinder 76.

The needle 38, which has one end portion press-fitted or welded to the movable core 73, is assembled integrally with the movable core 73. The other end portion of the needle 38 can abut on the wall surface of the disc portion 36 of the valve member 35 which faces the valve seat 34. A spring 22 is provided between the stator core 72 and the movable core 73. The movable core 73 is biased toward the valve member 35, due to the elastic force of the spring 22. The elastic force of the spring 22 that biases the movable core 73 is made larger than the elastic force of the spring 21 that biases the valve member 35. Namely, the spring 22 biases the movable core 73 and the needle 38 toward the valve member 35, namely, in the valve opening direction of the valve member 35, against the elastic force of the spring 21. With this arrangement, when the coil 71 is not energized, the stator core 72 and the movable core 73 are spaced apart from each other. Therefore, when the coil 71 is not energized, the needle 38 integral with the movable core 73 moves toward the valve member 35 due to the elastic force of the spring 22, and the valve member 35 is spaced apart from the valve seat 34 of the valve body 30. Thus, the needle 38 abuts on the disc portion 36 due to the elastic force of the spring 22, so as to press the valve member 35 in the valve opening direction.

Next, the damper device 10 will be described. The housing 11 has a damper housing 110 in the form of a cylinder with a bottom, which is located on the side of the pressurizing chamber 121 opposite to the plunger 13. The fuel chamber 16 is formed within the damper housing 110. The fuel chamber 16 is provided on substantially the same axis as the plunger 13. The lid member 12 is formed of, for example, stainless steel, in the form of a cylinder with a bottom. An opening end portion of the lid member 12 is joined to the outer wall of the damper housing 110 by welding, for example, so that the lid member 12 closes the opening 7 (shown in FIG. 2) of the fuel chamber 16. The guide passage 111, passage 108, and low-pressure fuel pipe (not shown) are connected to the fuel chamber 16. Therefore, the fuel chamber 16 communicates with the pressurizing chamber 121, variable volume chamber 122, and the low-pressure fuel pump (not shown) that pumps up the fuel of the fuel tank.

Figure 2:
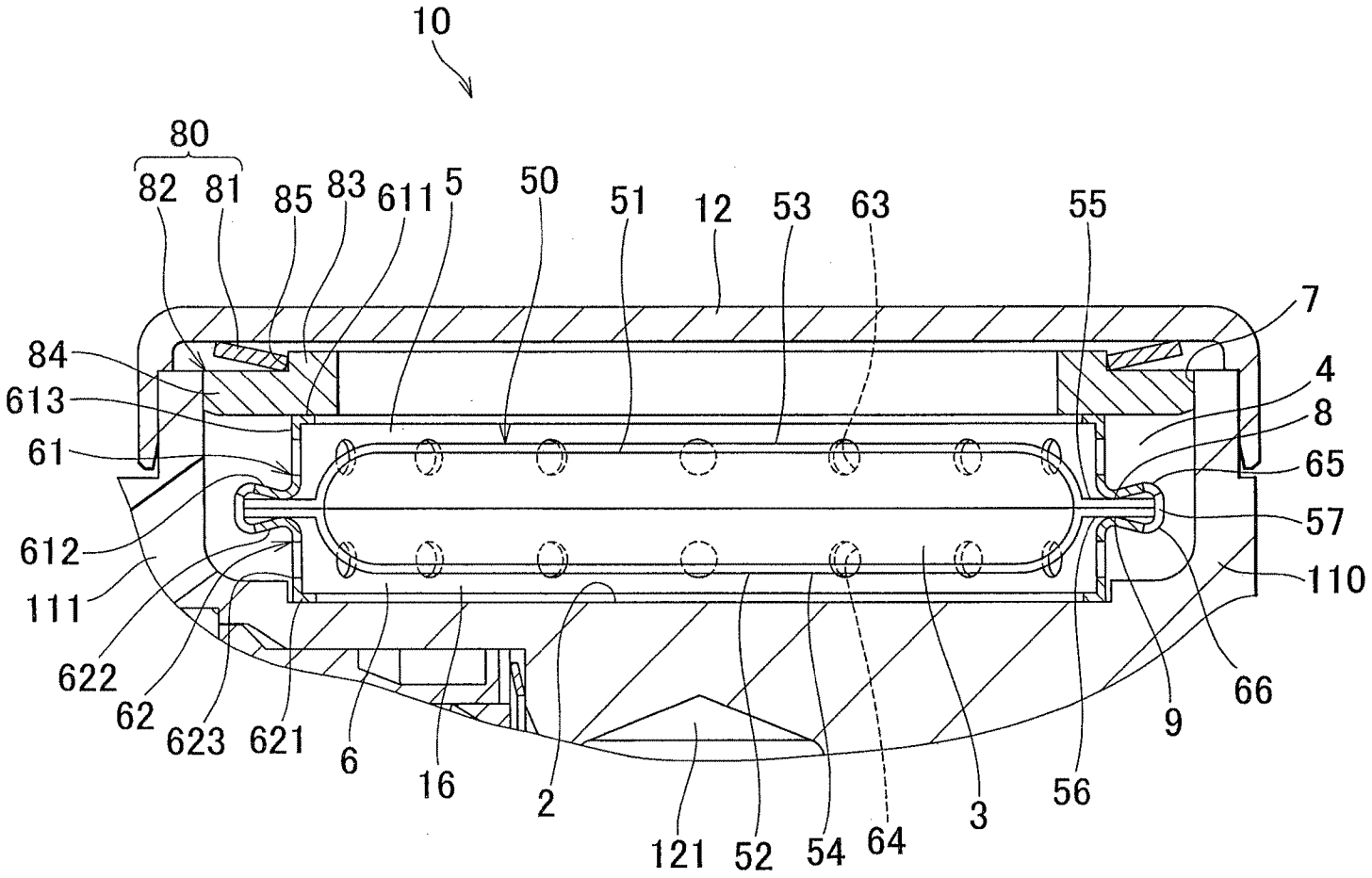
FIG. 2 is a cross-sectional view showing a damper device of the high-pressure pump of FIG. 1, and its surroundings.

As shown in FIG. 2, the damper device 10 includes a pulsation damper 50 as a damper member, an upper support member 61, a lower support member 62, a pressing means 80, and so forth. The pulsation damper 50 has an upper diaphragm 51 and a lower diaphragm 52. Each of the upper diaphragm 51 and the lower diaphragm 52 is formed in the shape of a dish, by pressing a metal plate formed of, for example, stainless steel. The upper, diaphragm 51 has an elastically deformable, dish-shaped concave portion 53 formed in a middle portion thereof, and an upper peripheral portion 55 in the form of an annular, thin sheet provided integrally at the periphery of the dish-shaped concave portion 53. Similarly, the lower diaphragm 52 has a dish-shaped concave portion 54 and a lower peripheral portion 56.

The upper peripheral portion 55 of the upper diaphragm 51 and the lower peripheral portion 56 of the lower diaphragm 52 are welded to each other over the entire circumference in the circumferential direction, to thus form a welded portion 57. As a result, an airtight chamber 3 is formed between the upper diaphragm 51 and the lower diaphragm 52. For example, helium gas, or argon gas, or a mixture thereof is sealed (i.e., airtightly enclosed) in the airtight chamber 3 at a given pressure. The upper diaphragm 51 and the lower diaphragm 52 are adapted to elastically deform in response to changes in the pressure of the fuel chamber 16. As a result, the volume of the airtight chamber 3 changes, and pressure pulsation of the fuel flowing through the fuel chamber 16 is reduced. The thickness and material of the upper diaphragm 51 and lower diaphragm 52, the pressure at which the gas is sealed in the airtight chamber 3, and other parameters are set according to required durability and other requirements, so that the spring constant of the upper diaphragm 51 and lower diaphragm 52 is set appropriately. With the spring constant thus set, the frequency of pulsation that can be damped or reduced by the pulsation damper 51 is determined. Also, the pulsation reduction effect of the pulsation damper 50 changes depending on the size or volume of the airtight chamber 3.

Each of the upper support member 61 and the lower support member 62 is formed in a generally cylindrical shape, by subjecting a metal plate of, for example, stainless steel to press work or bending work. The upper support member 61 has a cylindrical portion 613, an inward flange 611, an outward flange 612, and a claw portion 65. The cylindrical portion 613 is formed in a cylindrical shape, and has a plurality of upper communication holes 63. The inward flange 611 having an annular shape extends inward from one axial end of the cylindrical portion 613, and is formed perpendicularly to the axis of the upper support member 61. The outward flange 612 having an annular shape extends outward from the other axial end of the cylindrical portion 613, and is bent so as to be inclined toward one end of the upper support member 61. The claw portion 65 extends further outward from the outer end portion of the outward flange 612, and its distal end is bent toward the other end of the upper support member 61.

The lower support member 62 has a cylindrical portion 623, an inward flange 621, an outward flange 622, and a claw portion 66. The cylindrical portion 623 is formed in a cylindrical shape, and has a plurality of lower communication holes 64. The inward flange 621 having an annular shape extends inward from one axial end of the cylindrical portion 623, and is formed perpendicularly to the axis of the lower support member 62. The outward flange 622 having an annular shape extends outward from the other axial end of the cylindrical portion 623, and is bent so as to be inclined toward one end of the lower support member 62. The claw portion 66 extends further outward from the outer end portion of the outward flange 622, and its distal end is bent toward the other end of the lower support member 62.

The claw portions 65, 66 securely hold the welded portion 57 of the upper diaphragm 51 and the lower diaphragm 52. Therefore, relative movements of the upper support member 61, lower support member 62 and the pulsation damper 50 in radial directions are restricted. The outward flange 612 of the upper support member 61 and the upper peripheral portion 55 of the upper diaphragm 51 abut on each other over the entire circumference, to form an upper abutting portion 8. The outward flange 622 of the lower support member 62 and the lower peripheral portion 56 of the lower diaphragm 52 abut on each other over the entire circumference, to form a lower abutting portion 9.

A cylindrical recessed portion 2 that is recessed toward the pressurizing chamber 121 is provided on an inner wall of the damper housing 110 remote from the lid member 12. The inward flange 621 of the lower support member 62 is fitted in the recessed portion 2. Therefore, the upper support member 61, lower support member 62, and the pulsation damper 50 are inhibited from moving in radial directions in the fuel chamber 16. With this arrangement, an outside space 4 is formed between the inner wall of the damper housing 110, and the outer wall of the upper support member 61 and the outer wall of the lower support member 62. The outside space 4 thus formed surrounds the upper support member 61 and the lower support member 62.

An inside space 5 is formed within the upper support member 61. An inside space 6 is formed within the lower support member 62. The pulsation damper 50 provides a partition between the inside space 5 and the inside space 6. However, the fuel flows between the outside space 4 and the inside space 5 of the upper support member 61 via the upper communication holes 63, and the fuel flows between the outside space 4 and the inside space 6 of the lower support member 62 via the lower communication holes 64.

The pressing means 80 has a force transmitting member 82, and a disc spring 81 as an elastic member. The force transmitting member 82 having an annular shape is formed of, for example, stainless steel, and is provided on the lid member 12 side of the upper support member 61. The force transmitting member 82 has an annular portion 84 and a protruding portion 83. One axial face of the annular portion 84 closer to the upper support member 61 as viewed in the axial direction is formed in a plane perpendicular to the axis of the annular portion 84. Therefore, the annular portion 84 and the inside flange 611 of the upper support member 61 are in surface contact with each other over the entire circumference. With this arrangement, the elastic force of the disc spring 81 acts substantially uniformly on the force transmitting member 82. The outer wall of the annular portion 84 is guided by the inner wall of the damper housing 110. Therefore, the force transmitting member 82 is inhibited from moving in radial directions in the fuel chamber 16. The protruding portion 83 protrudes from a radially inner end portion of the annular portion 84 toward the lid member 12. Therefore, a step is formed between the outer wall of the protruding portion 83 and one axial face of the annular portion 84 closer to the lid member 12. The axial face of the annular member 84 closer to the lid member 12, which face is formed adjacent to the step, provides an engaging portion 85 that engages with the disc spring 81.

The disc spring 81 having an annular shape is formed of, for example, stainless steel. One end of the disc spring 81 abuts on the lid member 12. The other end of the disc spring 81 abuts on the engaging portion 85 over the entire circumference. The diameter of the disc spring 81 measured at the other end abutting on the engaging portion 85 is smaller than the diameter thereof measured at the above-indicated one end abutting on the lid member 12. Therefore, the other end of the disc spring 81 is guided by the outer wall of the protruding portion 83. With this arrangement, the disc spring 81 is inhibited from moving in radial directions relative to the force transmitting member 82. The elastic force of the disc spring 81 is transmitted to the upper support member 61 and the lower support member 62 via the force transmitting member 82, and acts on the upper abutting portion 8 and the lower abutting portion 9. Then, the upper support member 61 presses the upper peripheral portion 55 at the upper abutting portion 8, and the lower support member 62 presses the lower peripheral portion 56 at the lower abutting portion 9.

Next, the operation of the high-pressure pump 1 constructed as described above will be explained.

The high-pressure pump 1 repeats the intake stroke, the metering stroke, and the pressurizing stroke, which will be described below, so as to pressurize the fuel drawn into the pump 1 and discharge the pressurized fuel. The amount of the fuel discharged is adjusted by controlling the timing of application of electric current to the coil 71 of the electromagnetic drive unit 70 (i.e., the timing of energization of the coil 71). The intake stroke, metering stroke and pressurizing stroke will be specifically described.

First, the intake stroke will be described. When the plunger 13 moves downward in FIG. 1, the energization of the coil 71 is stopped. Therefore, the valve member 35 is biased toward the pressurizing chamber 121, by the needle 38 integral with the movable core 73 that receives the elastic force of the spring 22. As a result, the valve member 35 is spaced apart from the valve seat 34 of the valve body 30. Also, when the plunger 13 moves downward in FIG. 1, the pressure in the pressurizing chamber 121 is lowered. Therefore, the force the valve member 35 receives from the fuel on the side opposite to the pressurizing chamber 121 becomes larger than the force the valve member 35 receives from the fuel on the pressurizing chamber 121 side. As a result, the force is applied to the valve member 35 in such a direction as to cause the valve member 35 to move away from the valve seat 34, and the valve member 35 is spaced apart from the valve seat 34. The valve member 35 moves until the guide member 37 abuts on the stepped surface 501 of the stopper 40. With the valve member 35 thus spaced apart from the valve seat 34, namely, placed in the open position, the fuel in the fuel chamber 16 is drawn into the pressurizing chamber 121, via the guide passage 111, passage 151, annular fuel passage 101, passage 102, and the intake passage 112. At this time, the fuel in the passage 102 is allowed to flow into the volume chamber 41 through the conduit 42. Therefore, the pressure in the volume chamber 41 becomes substantially equal to the pressure in the passage 102.

Secondly, the metering stroke will be described. When the plunger 13 moves upward from the bottom dead center toward the top dead center, force is applied from the fuel on the pressurizing chamber 121 side to the valve member 35 in such a direction as to cause the valve member 35 to rest on the valve seat 34, due to flow of low-pressure fuel discharged from the pressurizing chamber 121 toward the fuel chamber 16. However, when the coil 71 is not energized, the needle 38 is biased toward the valve member 35 due to the elastic force of the spring 22. Therefore, movement of the valve member 35 toward the valve seat 34 is restricted by the needle 38. Also, the wall surface of the valve member 35 on the pressurizing chamber 121 side is covered with the stopper 40. With this arrangement, the dynamic pressure developed by the flow of the fuel discharged from the pressurizing chamber 121 toward the fuel chamber 16 is prevented from being directly applied to the valve member 35. Therefore, the force applied to the valve member 35 in the valve-closing direction due to the fuel flow is reduced.

During the metering stroke, while the energization of the coil 71 is stopped (i.e., while no current is applied to the coil 71), the valve member 35 is spaced apart from the valve seat 34, and is kept in a condition where the valve member 35 abuts on the stepped surface 501. In this condition, the fuel discharged from the pressurizing chamber 121 due to the rise or upward movement of the plunger 13 is returned to the fuel chamber 16, via the intake passage 112, passage 102, annular fuel passage 101, passage 151, and the guide passage 111, namely, in the order opposite to that of the case where the fuel is drawn from the fuel chamber 16 into the pressurizing chamber 121.

If the coil 71 is energized during the metering stroke, a magnetic field is generated by the coil 71, and a magnetic circuit is formed by the stator core 72, flange 75 and the movable core 73. As a result, magnetic attraction develops between the stator core 72 and the movable core 73 which are spaced apart from each other. If the magnetic attraction generated between the stator core 72 and the movable core 73 becomes larger than the elastic force of the spring 22, the movable core 73 moves toward the stator core 72. Therefore, the needle 38 integral with the movable core 73 also moves toward the stator core 72. As the needle 38 moves toward the stator core 72, the valve member 35 and the needle 38 move away from each other, and the valve member 35 ceases to receive force from the needle 38. As a result, the valve member 35 moves toward the valve seat 34, due to the elastic force of the spring 21, and the force applied to the valve member 35 in the valve-closing direction due to the flow of the low-pressure fuel discharged from the pressurizing chamber 121 toward the fuel chamber 16. In this manner, the valve member 35 rests on the valve seat 34. With the valve member 35 thus closed, the flow of the fuel through the fuel passage 100 is interrupted, whereby the metering stroke in which the low-pressure fuel is discharged from the pressurizing chamber 121 to the fuel chamber 16 ends. By closing the passage between the pressurizing chamber 121 and the fuel chamber 16 while the plunger 13 moves upward, the amount of the low-pressure fuel returned from the pressurizing chamber 121 to the fuel chamber 16 is adjusted as desired. Consequently, the amount of the fuel pressurized in the pressurizing chamber 121 is determined.

Thirdly, the pressurizing stroke will be described. As the plunger 13 further moves upward toward the top dead center in the condition where the passage between the pressurizing chamber 121 and the fuel chamber 16 is closed, the pressure of the fuel in the pressurizing chamber 121 is elevated. When the pressure of the fuel in the pressurizing chamber 121 becomes higher than a given pressure level, the check valve 92 moves away from the valve seat 95, against the elastic force of the spring 94 of the discharge valve unit 90 and the force the check valve 92 receives from the fuel on the downstream side of the valve seat 95. As a result, the discharge valve unit 90 is opened, and the fuel pressurized in the pressurizing chamber 121 is discharged from the high-pressure pump 1 through the discharge passage 114. The fuel discharged from the high-pressure pump 1 is supplied to the delivery pipe (not shown) for accumulation, and then supplied to the injectors.

When the plunger 13 moves up to the top dead center, the energization of the coil 71 is stopped, and the valve member 35 moves away from the valve seat 34 again. Then, the plunger 13 moves downward in FIG. 1 again, and the pressure of the fuel in the pressurizing chamber 121 is lowered. As a result, the fuel is drawn from the fuel chamber 16 into the pressurizing chamber 121.

The energization of the coil 71 may be stopped when the valve member 35 is closed and the pressure of the fuel in the pressurizing chamber 121 rises up to a predetermined value. As the pressure of the fuel in the pressurizing chamber 121 rises, the force the valve member 35 receives from the fuel on the pressurizing chamber 121 side in such a direction as to cause the valve member 35 to rest on the valve seat 34 becomes larger than the force the valve member 35 receives in such a direction as to cause the valve member 35 to move away from the valve seat 34. Therefore, even if the energization of the coil 71 is stopped, the valve member 35 is kept in the seated condition in which the valve member 35 rests on the valve seat 34, due to the force received from the fuel on the pressurizing chamber 121 side. By stopping the energization of the coil 71 at an appropriate time, the electric power consumed by the electromagnetic drive unit 70 (the power consumption of the electromagnetic drive unit 70) can be reduced.

Figure 3:
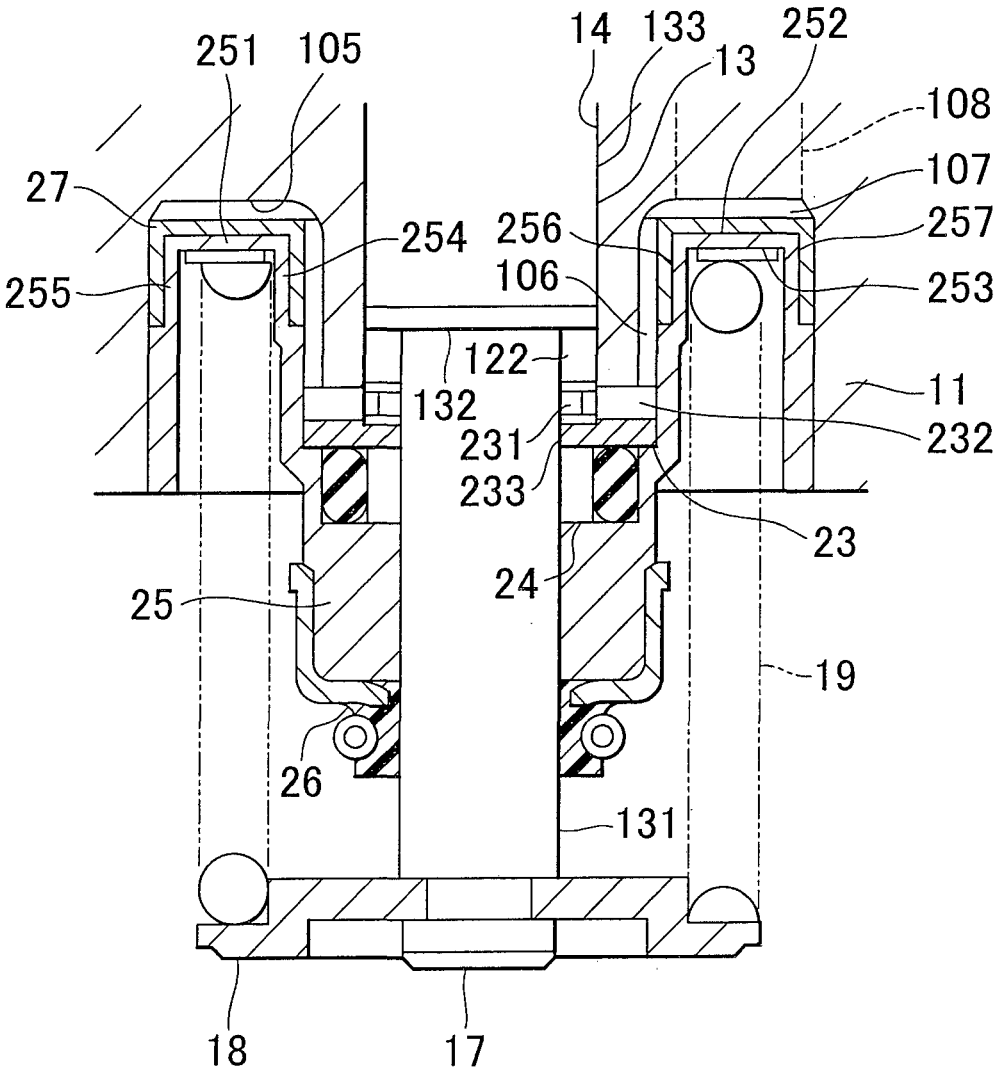
FIG. 3 is a cross-sectional view showing a spring seat of the high-pressure pump of FIG. 1, and its surroundings.

In the high-pressure pump 1 of this embodiment constructed as described above, a heat insulating member 27 is placed on an upper portion of the spring seat 25, as shown in FIG. 3. More specifically, a top face 252 of the bottom 251 of the spring seat 25, which faces the passage 107, is covered with the heat insulating material 27. The top face 252 is opposite to an abutting face 253 of the bottom 251 of the spring seat 25, on which the spring 19 abuts. Also, an upper portion (located adjacent to the bottom 251 of the spring seat 25) of an inner wall surface 256 of an inner cylindrical portion 254 of the spring seat 25 is covered with the heat insulating member 27.

The heat insulating member 27 is formed of PTFE. In this embodiment, the heat insulating member 27 is attached to the entire area of the top face 252 of the bottom 251, the upper portion of the inner wall surface 256 of the inner cylindrical portion 254, and an upper portion of an outer wall surface 257 of an outer cylindrical portion 255, so as to cover these portions. If PTFE is used as the material of the heat insulating material 27, the heat insulating member 27 can be produced at low cost, and the heat insulating member 27 can be easily mounted on the spring seat 25. It is, however, to be understood that the material of the heat insulating member 27 is not limited to PTFE, but may be selected from resins, metals, and other materials that have lower thermal conductivity than the spring seat 25 and are highly resistant to fuel.

In this embodiment in which the spring seat 25 is provided with the heat insulating member 27, the amount of heat which the fuel flowing through the passages 106, 107 receives from the spring seat 25 is reduced. More specifically, the spring seat 25 may receive heat of engine oil for lubricating a cam, the spring 19, etc., and may be thus heated to a high temperature, whereby the fuel flowing through the passages 106, 107 may receive heat from the spring seat 25, and the temperature of the fuel in the high-pressure pump 1 may become high. Due to the temperature rise of the fuel, vapor may be produced in the high-pressure pump 1, and may affect the control of the discharge amount of the high-pressure pump 1.

In this embodiment, however, the heat insulating member 27 provided on the spring seat 25 serves to curb heat exchange between the spring seat 25 and the fuel flowing through the passages 106, 107; therefore, the amount of heat which the fuel flowing through the passages 106, 107 receives from the spring seat 25 can be reduced. Then, even when the engine is in a fuel-cut mode or in a condition of high-temperature dead soak, for example, the fuel in the high-pressure pump 1 is prevented from being excessively high, as shown in FIG. 4.

Figure 4:
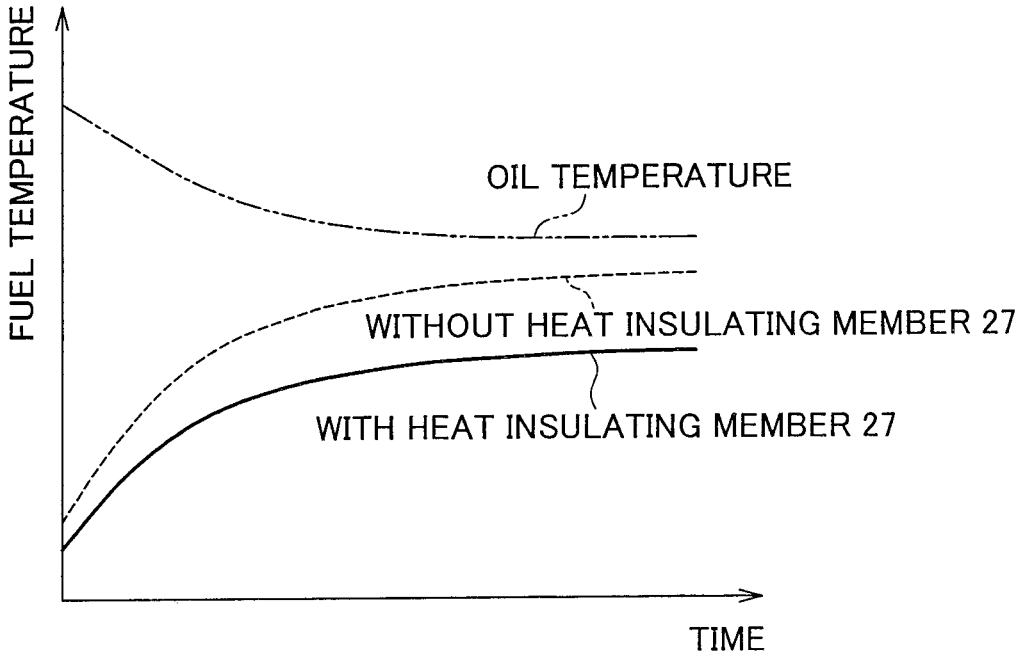
FIG. 4 is a graph useful for explaining the effect of the high-pressure pump of FIG. 1.

In FIG. 4, the vertical axis indicates the temperature of the fuel in the high-pressure pump 1, and the horizontal axis indicates an elapsed time from the start of fuel-cut or the start of high-temperature dead soak. In the graph of FIG. 4, the solid line indicates changes in the temperature of the fuel in the high-pressure pump 1 in the case where the heat insulating member 27 is provided, and the broken line indicates changes in the temperature of the fuel in the high-pressure pump 1 in the case where the heat insulating member 27 is not provided, while the two-dot chain line indicates changes in the temperature of the engine oil. As is understood from FIG. 4, when the heat insulating member 27 is provided, the temperature of the fuel in the high-pressure pump 1 can be reduced, and the rate of increase of the fuel temperature can also be reduced, during fuel-cut operation and high-temperature dead soak, as compared with the case where the heat insulating member 27 is not provided. Furthermore, the saturation temperature at which the temperature of the fuel in the high-pressure pump 1 is saturated can also be reduced.

Thus, the provision of the heat insulating member 27 on the spring seat 25 makes it possible to suppress temperature rise of the fuel in the high-pressure pump 1; therefore, vapor is less likely or unlikely to be produced in the high-pressure pump 1, and the influence of the vapor on the control of the discharge amount of the high-pressure pump 1 can be reduced or eliminated.

While only the upper portion of the inner wall surface 256 of the inner cylindrical portion 254 is covered with the heat insulating member 27 in the illustrated embodiment, the entire area of the inner wall surface 256 of the inner cylindrical portion 254 may be covered with the heat insulating member 27.

Figure 5:
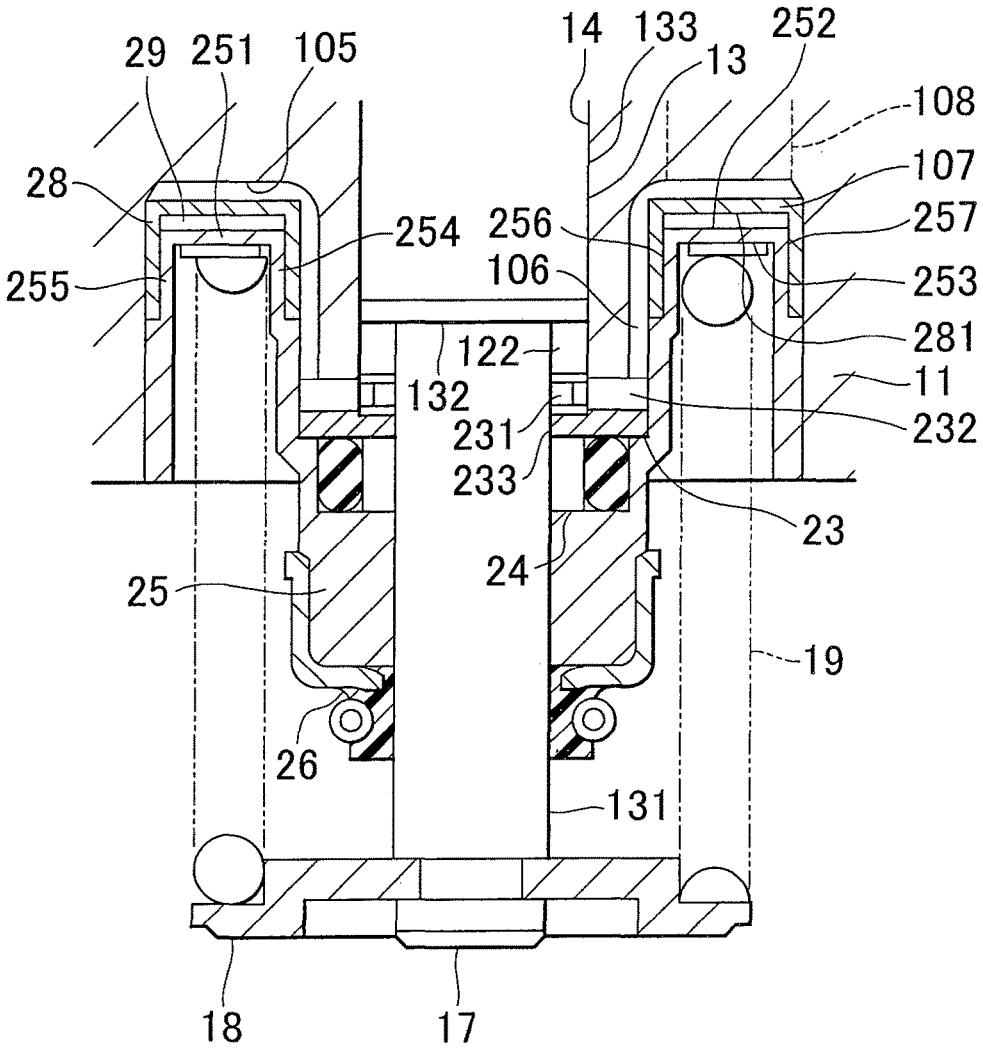
FIG. 5 is a view corresponding to FIG. 3 and showing a modified example of the high-pressure pump of FIG. 1.

As shown in FIG. 5, an air layer 29 may be interposed between a heat insulating member 28 and the spring seat 25. More specifically, the heat insulating member 28 shaped like a lid is placed on the upper portion of the spring seat 25. A clearance is provided between the top face 252 of the bottom 251 of the spring seat 25, and a bottom 281 of the heat insulating member 28, and air that is sealed in the clearance forms the air layer 29.

With this arrangement, the heat insulating member 28 and the spring seat 25 with the air layer 29 interposed therebetween provides a double-pipe structure, which can effectively curb heat exchange between the spring seat 25 and the fuel flowing through the passage 107. Accordingly, the amount of heat which the fuel flowing through the passage 107 receives from the spring seat 25 can be effectively reduced. Consequently, the temperature rise of the fuel in the high-pressure pump 1 can be further suppressed or reduced, and the influence on the control of the discharge amount of the high-pressure pump 1 can be further reduced.

While the invention is applied to the high-pressure pump 1 including the spring seat 25 integral with the oil seal holder in the illustrated embodiment, the invention may be applied to a high-pressure pump including a spring seat formed independently of an oil seal holder. Also, the invention may be applied to a high-pressure pump including a return pipe through which fuel that leaks from a clearance between the plunger 13 and the cylinder 14 is fed back to the low-pressure fuel pipe or fuel tank.

The present invention may be utilized in or applied to a high-pressure pump for supplying fuel to injectors of an internal combustion engine, such as a diesel engine or a gasoline engine.

The invention claimed is:

1. A high-pressure pump including a plunger capable of reciprocating, and a housing having a pressurizing chamber in which fuel is pressurized by the plunger, and a fuel chamber through which the fuel flows toward and from the pressurizing chamber, comprising:

a spring that biases the plunger in such a direction as to increase the volume of the pressurizing chamber;

a spring seat that is fixed to the housing and is in abutting contact with one end of the spring, wherein a first space through which the fuel flows is provided between a bottom of the spring seat and the housing, and the first space communicates with the fuel chamber via a fuel passage formed in the housing; and a heat insulating member that covers a face of the bottom of the spring seat, which face is exposed to the first space, wherein the heat insulating member is formed of a material that has a lower thermal conductivity than that of the spring seat, and is highly resistant to the fuel.

2. The high-pressure pump according to claim 1, wherein:

the spring seat includes a cylindrical portion that extends from an inner periphery of the bottom of the spring seat, in a direction opposite to the pressurizing chamber;

an annular space through which the fuel flows is provided between the cylindrical portion of the spring seat and the housing, and the annular space communicates with the first space between the bottom of the spring seat and the housing; and at least a portion of an inner wall surface of the cylindrical portion is covered with the heat insulating member.

3. The high-pressure pump according to claim 2, wherein an upper portion of the inner wall surface of the cylindrical portion, which is located adjacent to the bottom of the spring seat, is covered with the heat insulating member.

4. The high-pressure pump according to claim 2, wherein the entire area of the inner wall surface of the cylindrical portion is covered with the heat insulating member.

5. The high-pressure pump according to claim 1, wherein an air layer is interposed between the heat insulating member and the spring seat.

* * * * *